US007757519B2

(12) United States Patent
Lonati

(10) Patent No.: US 7,757,519 B2
(45) Date of Patent: Jul. 20, 2010

(54) METHOD TO PRODUCE TEXTILES ARTICLES WITH WARP-KNITTING MACHINES AND MACHINE TO CARRY OUT SUCH A METHOD

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/418,275

(22) Filed: Apr. 3, 2009

(65) Prior Publication Data

US 2009/0301141 A1 Dec. 10, 2009

(30) Foreign Application Priority Data

Jun. 4, 2008 (IT) ..... BS2008A0115

(51) Int. Cl.
*D04B 27/32* (2006.01)

(52) U.S. Cl. ..... 66/205

(58) Field of Classification Search ..... 66/195, 66/203, 204, 207, 214
See application file for complete search history.

(56) References Cited

U.S. PATENT DOCUMENTS

| | | | | | |
|---|---|---|---|---|---|
| 4,549,414 | A | * | 10/1985 | Zorini et al. | 66/203 |
| 4,570,462 | A | * | 2/1986 | Roth | 66/204 |
| 4,841,750 | A | * | 6/1989 | Zorini | 66/204 |
| 5,150,587 | A | * | 9/1992 | Bergmann | 66/195 |
| 5,172,570 | A | * | 12/1992 | Wade et al. | 66/195 |
| 5,353,611 | A | * | 10/1994 | Wade et al. | 66/207 |
| 5,440,902 | A | * | 8/1995 | Wieland et al. | 66/194 |
| 5,628,210 | A | | 5/1997 | Mista et al. | |
| 7,320,233 | B2 | | 1/2008 | Lonati | |
| 2005/0284187 | A1 | | 12/2005 | Mista | |
| 2007/0209402 | A1 | | 9/2007 | Lonati | |

FOREIGN PATENT DOCUMENTS

| | | | |
|---|---|---|---|
| DE | 198 01 601 | C1 | 3/1999 |
| EP | 1 840 254 | A2 | 10/2007 |
| GB | 2 289 063 | A | 11/1995 |
| JP | 63 092762 | A | 4/1988 |

* cited by examiner

*Primary Examiner*—Danny Worrell
(74) *Attorney, Agent, or Firm*—Pearne & Gordon LLP

(57) ABSTRACT

A method for producing textile articles with warp-knitting machines, comprising a plurality of steps of shifting at least a first thread-guide (3) bar (2) of jacquard type with shog translational movements and with swing transversal movements, so as to produce textile articles on at least one needle bed (52), shifting at least the first thread-guide (3) bar (2) by means of a corresponding first linear motor, with a shog movement of a first predefined width; varying automatically through control devices (60) the shift controlled by the first linear motor so as to vary the width of the shog movement during the production of the textile articles, and shifting at least the first thread-guide (3) bar (2) with a shog movement having a second predefined width differing from the first one, and automatically controlling by means of the control devices (60) connected to the first thread guide (3) bar (2) at least an individual shift of a needle space of at least a first thread-guide (3) of the first bar (2), in addition to or in deduction from and during at least one of said shog movements.

20 Claims, 10 Drawing Sheets

Fig. 4
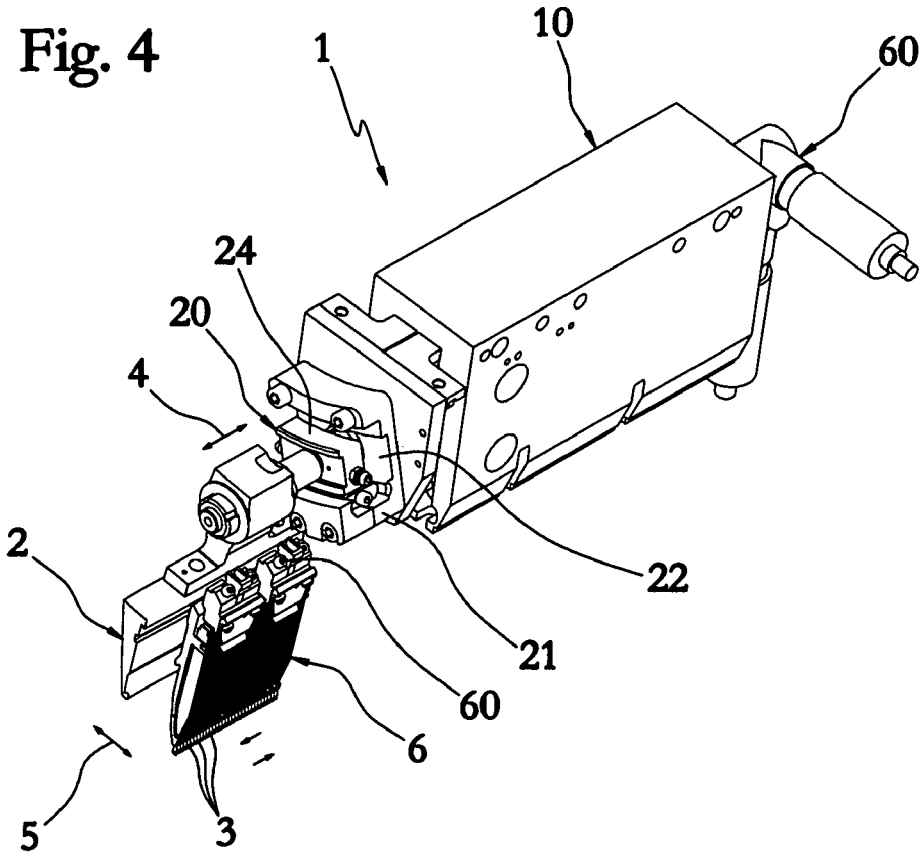
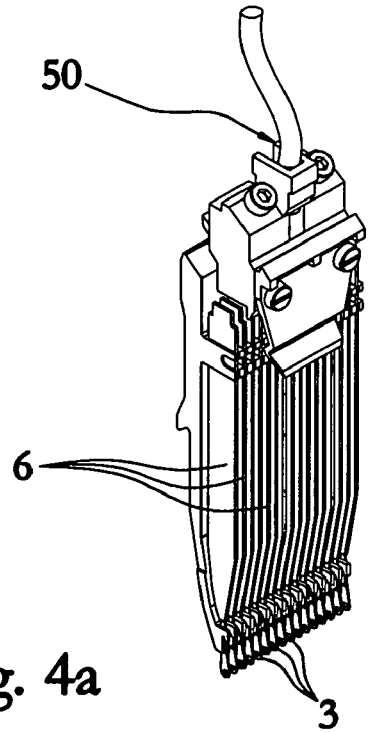
Fig. 4a

METHOD TO PRODUCE TEXTILES ARTICLES WITH WARP-KNITTING MACHINES AND MACHINE TO CARRY OUT SUCH A METHOD

FIELD OF THE INVENTION

The present invention relates to a method for producing textile articles with warp-knitting machines, such as Raschel-type warp looms and the like.

The present invention further relates to a warp-knitting machine for carrying out such a method and the products resulting from such a method.

DESCRIPTION OF RELATED ART

As is known, linear warp-knitting machines are provided with a plurality of bars designed to carry a plurality of thread-holding elements, commonly known as thread-guides. Said bars should be moved so as to enable the threads associated with such thread-guides to be correctly fed onto the needles of the knitting machine for the formation of new fabric.

In order to achieve its knitting task, the thread-guide bar makes two basic movements, i.e. a linear movement in front of or behind the hook of each needle, commonly known as "shog", and an oscillating movement on the side of each needle for bringing the threads alternatively before and behind the needle hook, commonly known as "swing".

Furthermore, it is known about jacquard-type thread-guide bars, which are provided with jacquard devices enabling to move each thread-guide individually of an additional needle space, in the same or opposite direction, with respect to the shog movement of said bars.

Said jacquard devices can be of mechanical, piezoelectric or pneumatic type.

Patent JP63092762 dated Sep. 30, 1986 introduces the use of piezoelectric elements associated with each thread-guide individually for the formation of jacquard fabrics on warp-knitting machines. According to said patent, the shifts of the piezoelectric elements can be made at any time and at a higher speed with respect to traditional mechanical systems, thus both when the thread-guide is before the needle hook (movement referred to as "overlap") and when it lies behind the needle hook (movement referred to as "underlap"), or when due to the shift of the bar (horizontal translation of the bar or shog), the latter shifts horizontally in both directions.

In such a system, which is shown in its essential components in FIG. 1, the shog shifts of the jacquard thread-guide bar provided with piezoelectric elements are preset by means of mechanical devices such as cams obtained with cam chains, or with a suitably shaped rotating disc making always the same alternated movement.

The system described above, resulting from the combination of bars provided with piezoelectric elements and the mechanical systems consisting of said chain or rotating disc, shows some drawbacks.

As a matter of fact, such a system is anyhow quite stiff, since the thread-guide bar can only follow the movements caused by the cam chains, whereas every time one might want to change the width and/or the sequence of shift of the thread-guide bars during the shog movement, specialized personnel is required for replacing mechanical parts, which means machine stop and production loss.

Therefore, such a system does not allow to freely change the shift width of the thread-guide bars during shog movements, since such width is defined univocally by the shape of the mechanical cams mounted onto the machine.

Moreover, the possible shift width is very small due to the mechanical configuration of the mechanism for actuating the thread-guide bars, and the thread-guide bar usually moves to and fro of a global width of two needle spaces, with two separate shifts following one another.

Italian patent application BS2006A000056 dated Mar. 8, 2006, granted and published in the USA under U.S. Pat. No. 7,320,233 on Jan. 22, 2008, which is referred to as an integral part of the present description, discloses the control of thread-guide bars (thread-guide holding bars) in a knitting machine without jacquard-type piezoelectric elements, by means of linear motors. The introduction to said patent describes and analyzes in a detailed manner known systems for moving thread-guide bars and the limitations thereof, and in particular said part of the description is to be regarded as an integral part of the present text as a reference. The technical solution disclosed in said patent allows anyhow a very swift and accurate movement of the thread-guide bars.

Known methods for producing textile articles with warp-knitting machines include a series of basic operating steps, which allow to produce various types of knitting stitches, such as the well known basic stitches referred to as "pillar stitch" (shown in FIG. 2), "tricot" (shown in FIG. 2*a*), "atlas lapping" and others. Beyond such basic stitches, other stitches deriving from the combination of specific shog movements of the thread-guide bar during the underlap and overlap movements and corresponding individual movements of single jacquard thread-guides in addition to the shog movement or in deduction from it, can be obtained. Two examples of known stitches deriving from such combinations of movements are shown in FIGS. 2*b* and 2*c*.

In the light of the above disclosure concerning the stiff mechanical structure of the mover for moving the thread-guide bars, it seems evident that the variety of stitches that can be obtained with known methods is limited and such methods are slow and expensive.

An aim of the present invention is to overcome the limits of the prior art by proposing a method for producing textile articles with warp-knitting machines and a warp-knitting machine without the drawbacks described.

A particular aim of the present invention is to provide a method and the corresponding equipment for producing fabrics characterized by more complex and complete jacquard patterns than the prior art, in a swift and economic manner.

Another aim of the present invention is to propose a warp-knitting machine enabling to carry out such a method, which is compact and has a limited number of components so as to be advantageous in terms of costs, life time and simplified management of said machine. A further aim of the present invention is to disclose a warp-knitting machine which is extremely accurate, with minimized clearances between the various components, so as to allow the implementation of such a method with high speeds (high dynamics), and which is simple to carry out and low-cost.

These and other aims, which shall be more evident from the following description, are achieved according to the present invention by a method for producing textile articles with warp-knitting machines and a warp-knitting machine according to the appended claims.

Further characteristics and advantages of the invention shall appear better from the description of a preferred, though not exclusive embodiment of the method and of the machine, disclosed to a merely indicative purpose in the following drawings.

BRIEF DESCRIPTION OF THE DRAWINGS

FIG. 4 shows a perspective view of the essential parts of a control device for jacquard thread-guide bars of warp-knitting machines according to the invention, wherein the device is associated with a first end part of jacquard-type thread guide bar;

FIG. 4*a* shows a detail of FIG. 4 concerning a set of thread-guides of the thread-guide bar;

Figure 1:
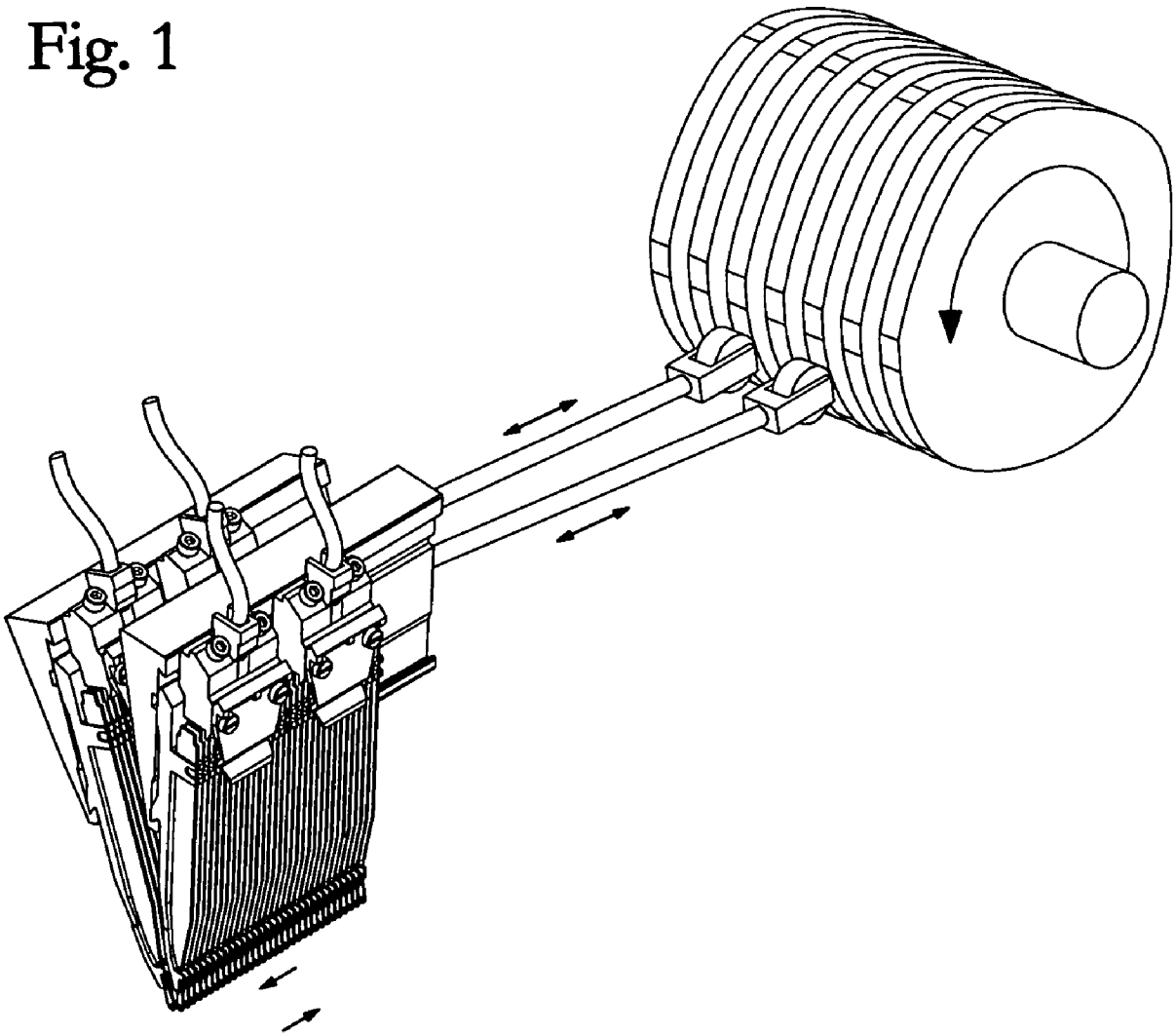
PRIOR ART Fig. 1
FIG. 1 shows a perspective view of components of a prior art system.
Figure 2:
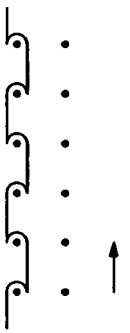
FIG. 2 shows a type of basic knitting stitch referred to as a pillar stitch.
Figure 2A:
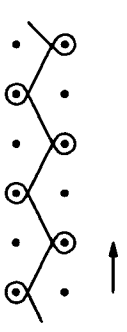
FIG. 2*a* shows a type of basic knitting stitch referred to as a tricot.
Figure 2B:
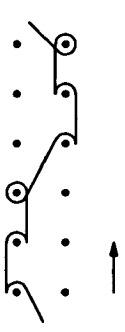
FIGS. 2*b* and 2*c* show known knitting stitches deriving from combinations of movements of thread-guide elements.
Figure 2C:
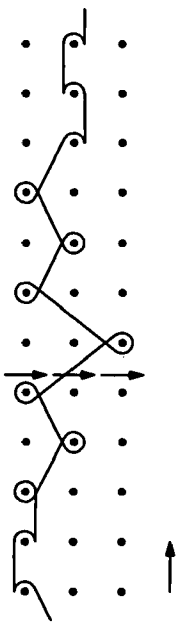

Referring to the figures mentioned above, a warp-knitting machine 50 according to the invention comprises a control device 1 for thread-guide 3 bars 2, provided with a linear motor 10 apt to transmit a shog translational motion, referred to with numeral 4, to the thread-guide bar 2, a mover 40 for moving the thread-guide bar 2 according to a swing oscillating motion, referred to with numeral 5 and basically perpendicular to said translational motion, and transmission devices 20 for transmitting to the thread-guide bar 2 the translational motion transmitted by the linear motor 10, thus enabling said bar 2 to move with an oscillating motion.

The device 1 is characterized in that the transmission devices 20 comprise a first transmission element 21 associated and integral with the linear motor 10, and a second transmission element 24 that can be integrally associable with the thread-guide bar 2. The first transmission element 21 further has a first guide 22 inside which the second transmission element 24 is movably engaged.

In an alternative embodiment, the second element 24 could have the first guide 22 and the first element 21 could be movably engaged inside said guide.

The first guide 22 advantageously has a basically curved shape, so as to allow the oscillating motion of the thread-guide bar 2. In particular, the first transmission element 21 has an inner cavity 23 having at least a basically curved shape so as to represent said guide 22 for the second transmission element 24, as can be seen in FIGS. 5, 7A, 7B and 8. Such element 24 has in its turn a first end portion 25 matching said cavity 23 so as to oscillate within it and enable the oscillating motion.

Preferably, said cavity 23 is defined by two distinct portions 21*a* of the first transmission element 21, apt to enclose the first end portion 25 of the second transmission element 24. In a preferred execution variant of the device 1, such cavity 23 has a quadrilateral side section and a curved front section, whereas the second transmission element 24 has a quadrilateral side section and a circular front section, so as to slide inside said cavity 23.

Figure 5:
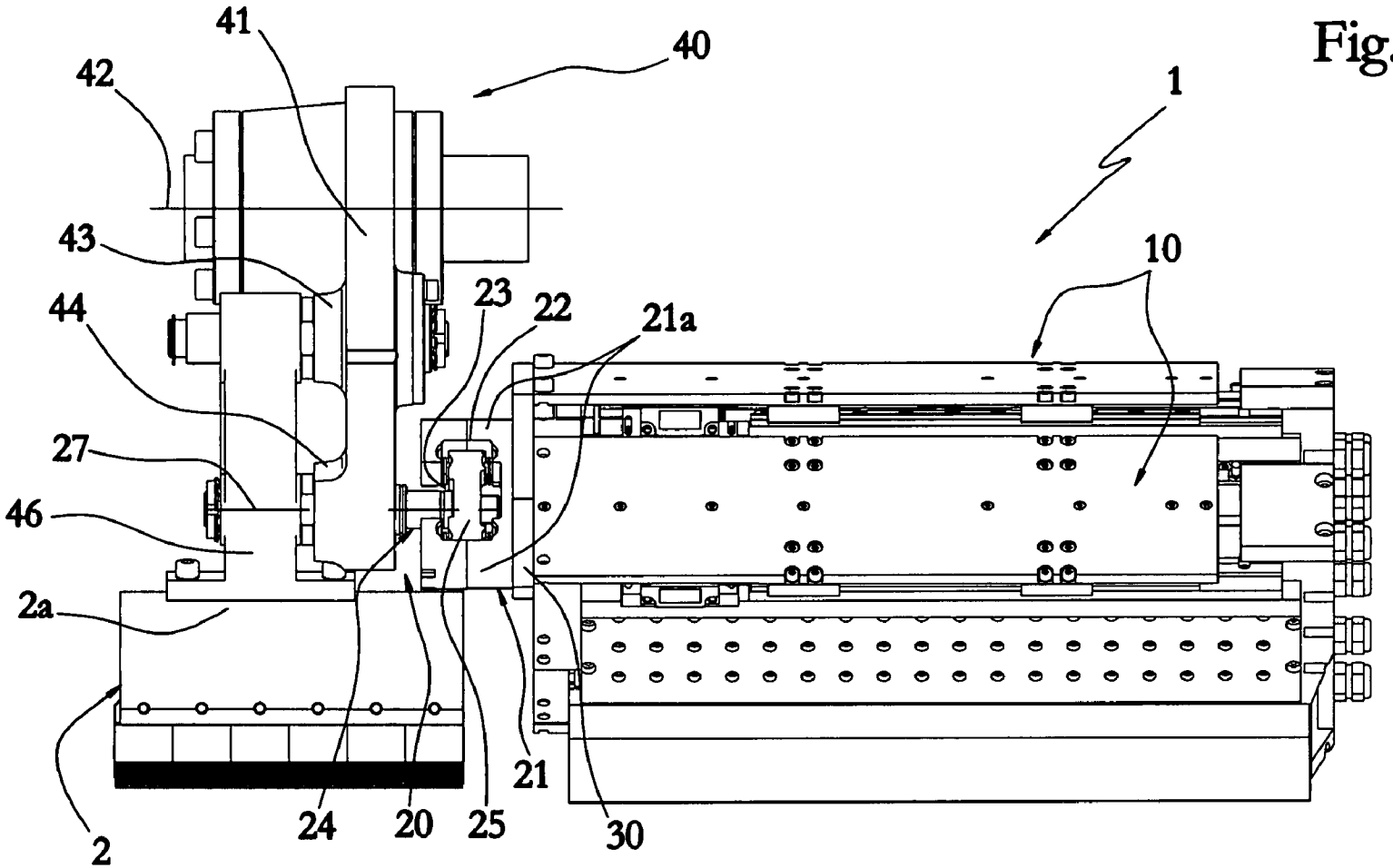
FIG. 5 shows a side view of the device of FIG. 4.

The transmission devices 20 also comprise a plurality of spheres 28 placed between the first 21 and the second 24 transmission element on the cavity 23 (FIG. 5). Moreover, these means 20 comprise a plurality of fastening elements 29 apt to increase pressure between the first transmission element 21, the second transmission element 24 and the spheres 28 on the (preloaded) cavity 23 so as to minimize clearances between the first 21 and the second 24 transmission element. In particular, the fastening elements 29 comprise screws associated with the first transmission element 21 so that their middle axis is basically parallel to the one of the first element 21, thus ensuring the fastening of such element 21 to the motor 10. As a result of the action of the screws, the space between the first 21 and the second 24 element on the cavity 23 is minimized but the radial sliding between the two elements 21, 24 is ensured by the action of the spheres 28.

Figure 11:
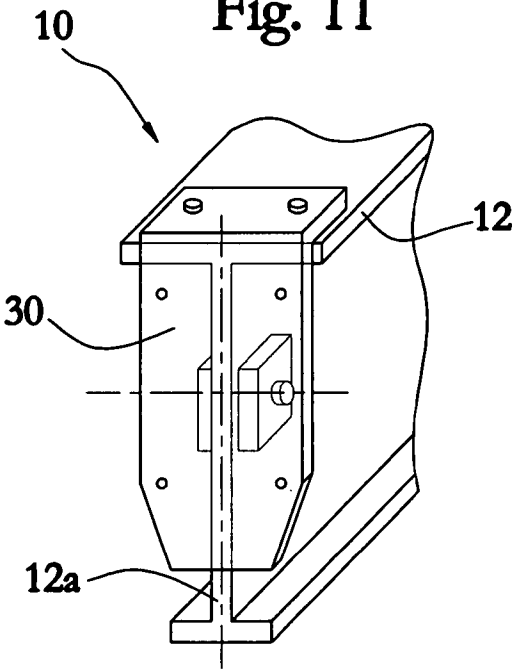
FIG. 11 shows an axonometric front view of an interface plate associated with the linear motor of FIG. 10.

According to the invention, the transmission devices 20 further comprise an interface plate 30 fastened to the linear motor 10 and shown in detail in FIG. 11. The first transmission element 21 is therefore associated with the motor 10 by means of said interface plate 30 and also the fastening elements 29 are associated with the interface plate 30.

Figure 7B:
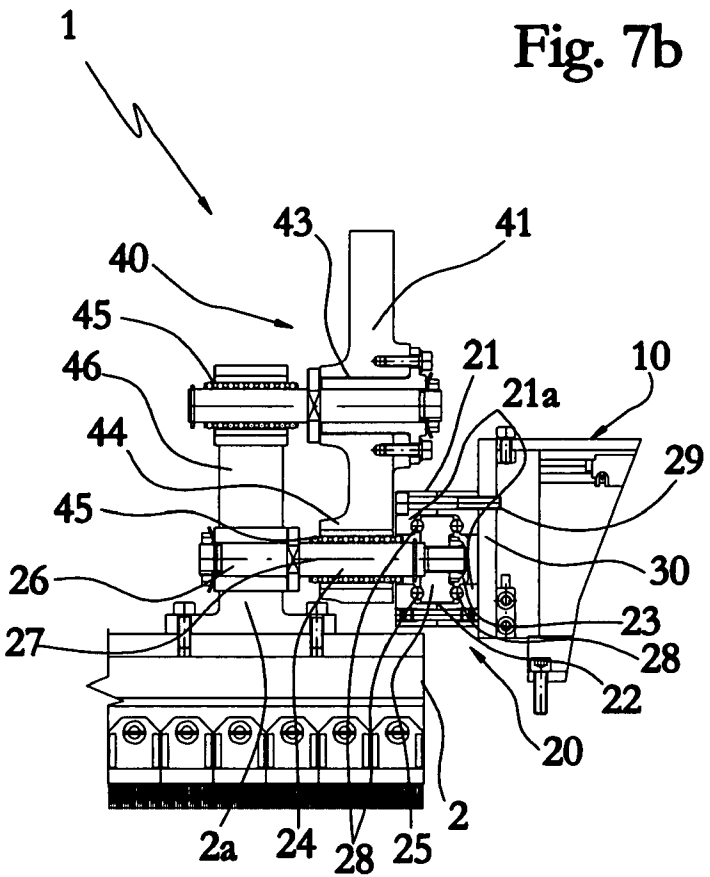
FIG. 7B shows a device similar to the one in FIG. 7A associated with a second end part of the thread-guide bar.
Figure 7A:
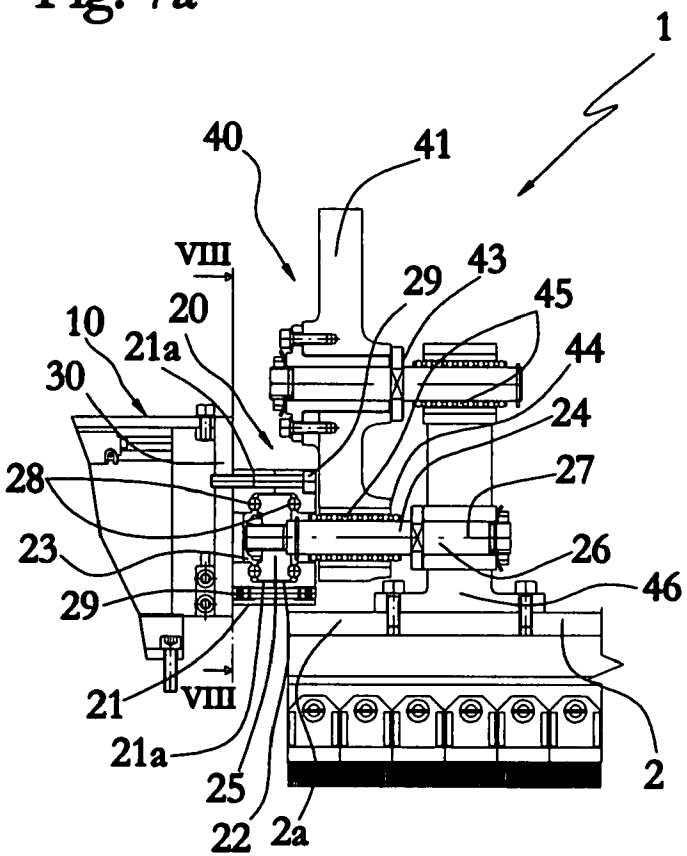
FIG. 7A shows a section of the device of FIG. 6 along line VII-VII.
Figure 8:
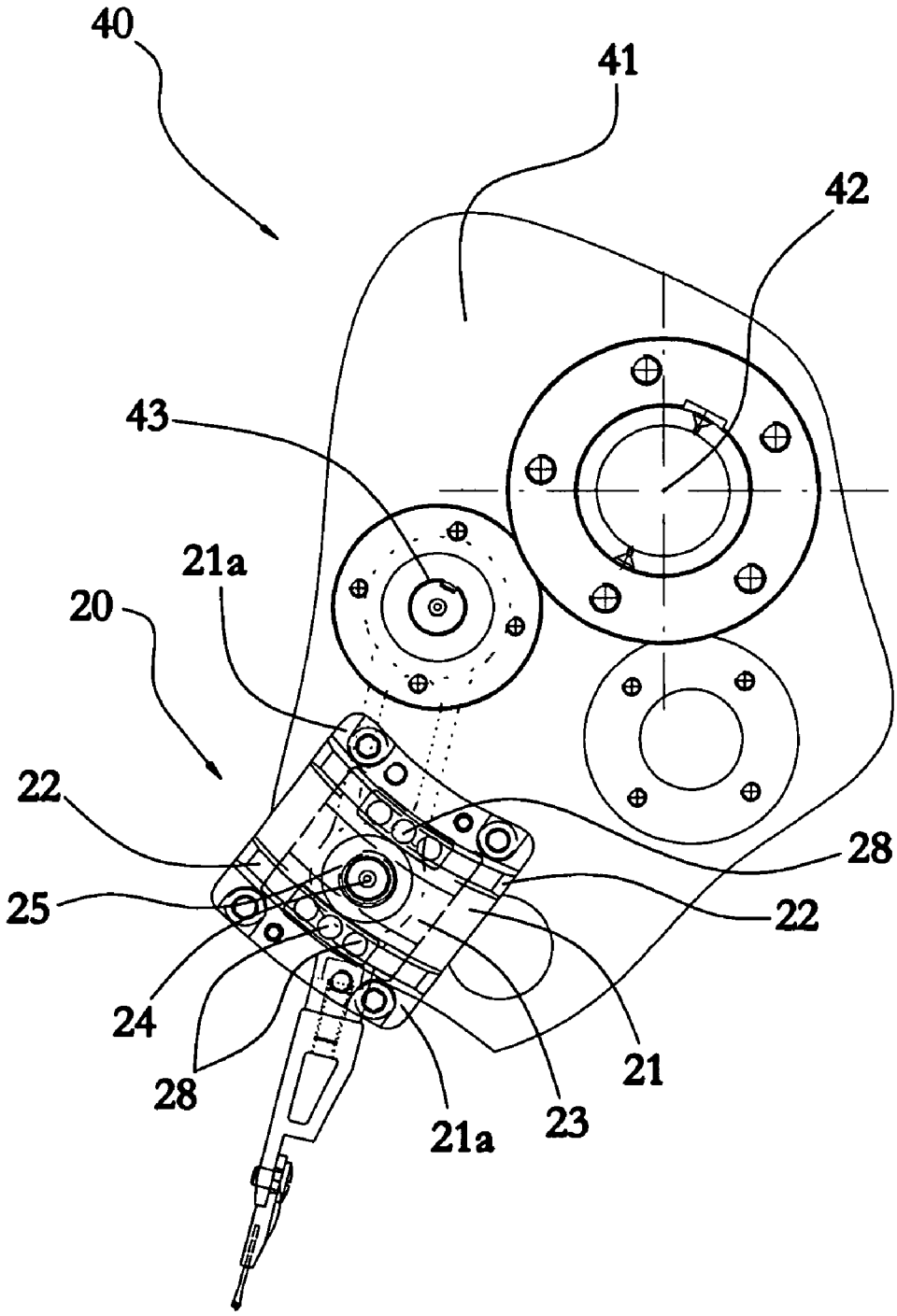
FIG. 8 shows a section of the device of FIG. 7A along line VIII-VIII.

The second transmission element 24 is integrally associated with the thread-guide bar 2 by means of its second end portion 26 (FIGS. 5, 7A and 7B). Such element 24 further has a middle axis 27 which is always parallel to a direction of the translational motion, i.e. also to the middle axis of the first transmission element 21 and to the one of the motor 10.

As is known, the linear motor 10 has at least a fixed part 11 and a moving part 12.

The fixed part 11 comprises coils apt to generate an electromagnetic field when an electric current passes through them, and the moving part 12 comprises magnets that are sensitive to such electromagnetic field. As a consequence, the moving part 12 is moved so as to generate the translational motion to be transmitted to the thread-guide bar 2 as a result of the action of said electromagnetic field upon said magnets.

Therefore, it is the moving part 12 of the motor 10 that transmits to the thread-guide bar 2 the translational motion through the transmission devices 20. As a matter of fact, the interface plate 30 or, if no interface plate 30 is present, the first transmission element 21 are fastened to an end portion 12*a* of the moving part 12 of the motor 10. The end portion 12*a* of the moving part 12 of the motor 10 can therefore have any shape provided that it enables the fastening to an interface plate 30 or, if required, to the first transmission element 21.

The linear motor 10 of the device 1 according to the present invention can also have the coils associated with the moving part 12 and the magnets associated with the fixed part 11. In this case, however, the reciprocal movement of the two parts would be more difficult since the electric supply cables should be associated with the moving part 12 and would therefore be continuously subject to shifts and vibrations.

In a preferred embodiment of the device 1, the motor 10 employed is a horizontal, linear iron-core motor piloted with 540 V direct current or with 110 V to 220 V alternated current, with fixed supply cables (since these are associated with the fixed part 11 of the motor 10).

Figure 6:
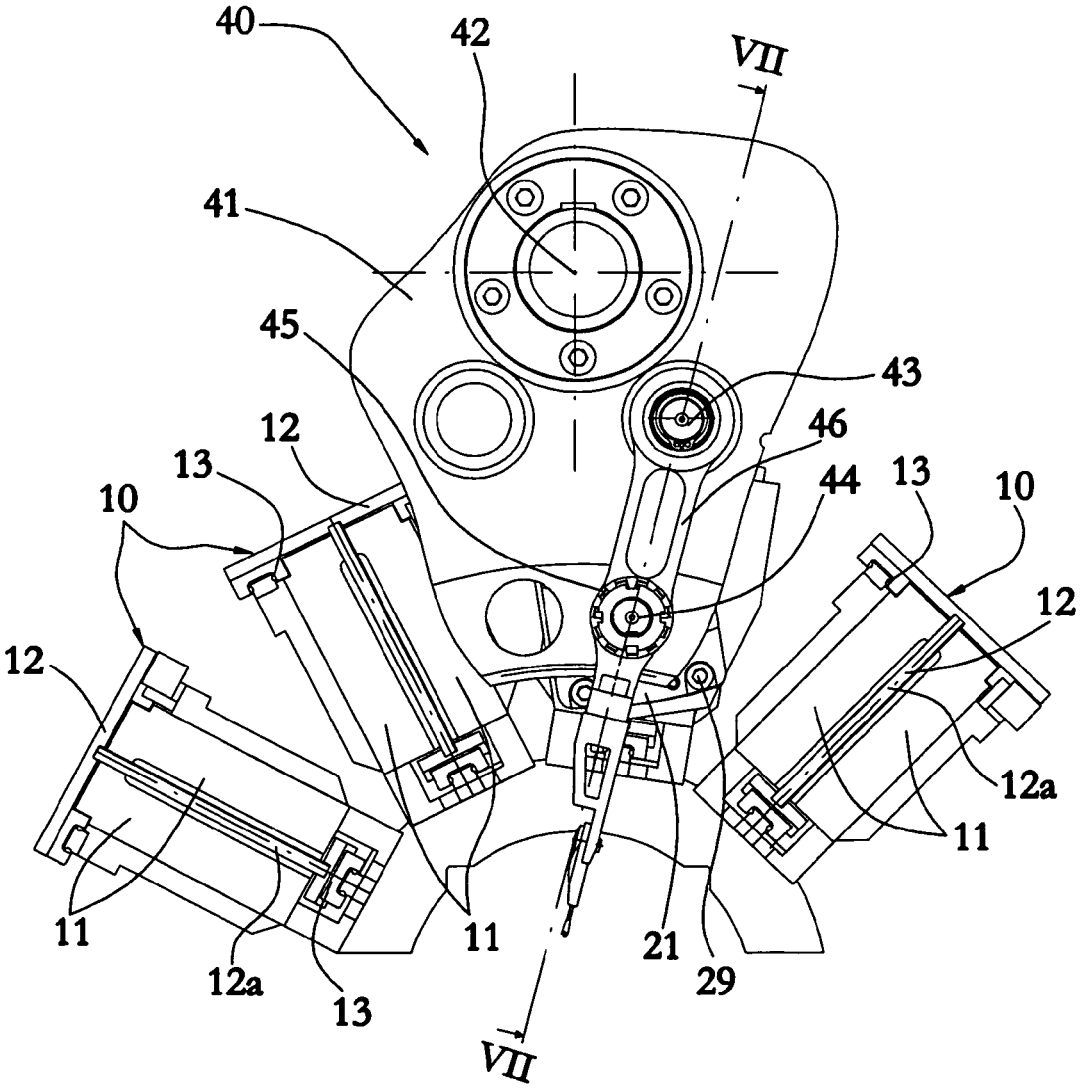
FIG. 6 shows a front view of the device of FIG. 4, wherein the motors are in accordance with a first execution variant.
Figure 9B:
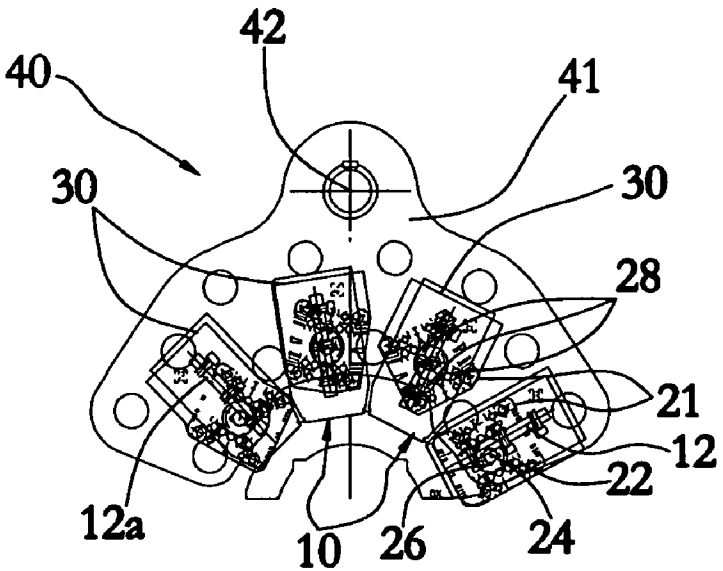
FIG. 9B shows a support for the linear knitting machine of FIG. 9A associated with a second end portion of the thread-guide bars.
Figure 9A:
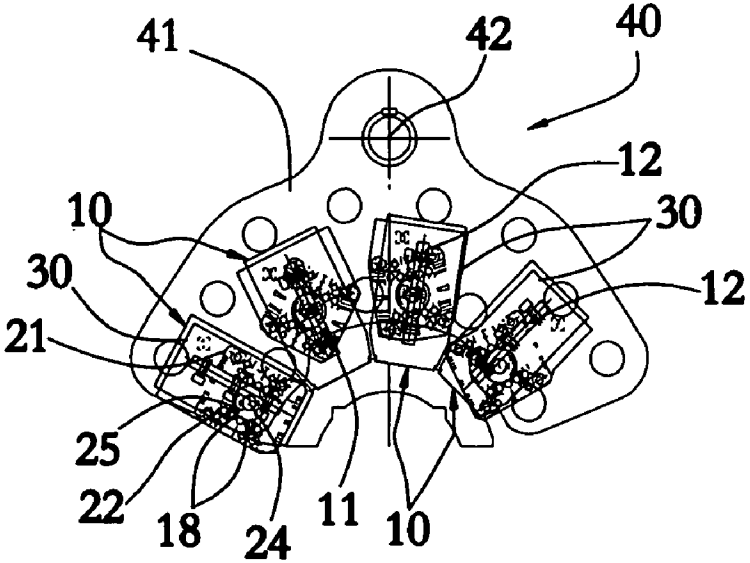
FIG. 9A shows a support for a linear knitting machine according to the invention associated with a first end portion of the thread-guide bars, in which the motors are in accordance with a second execution variant.
Figure 12:
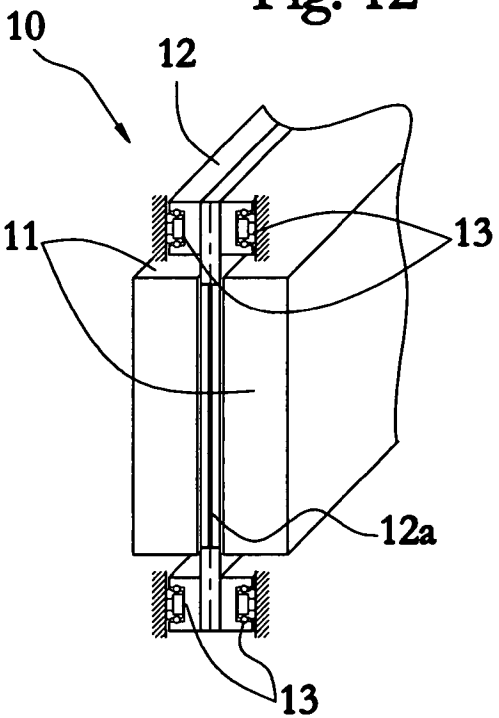
FIG. 12 shows an axonometric front view of a linear motor of the device of FIG. 4 in the second execution variant.
Figure 10:
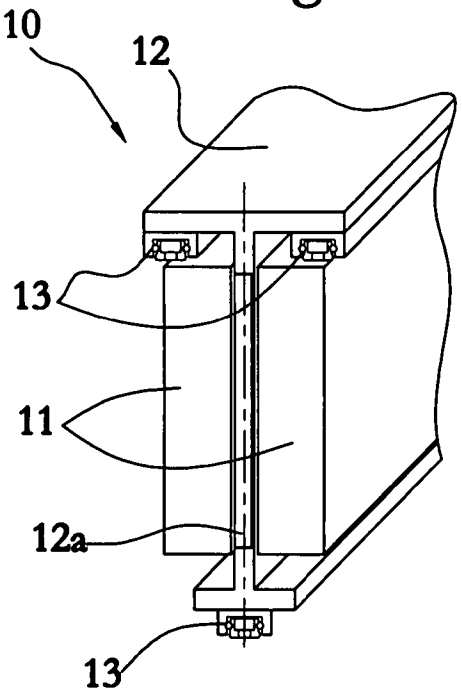
FIG. 10 shows an axonometric front view of a linear motor of the device of FIG. 4 in the first execution variant.

Advantageously, the motor 10 is characterized in that its moving part 12 is basically T-shaped and is placed between at least two fixed parts 11. The overall size of the motor 10 can thus be highly reduced, especially in the area contacting the thread-guide bar 2, overcoming the strong limitation of known devices due to the huge size difference between the moving part 12 of the motor 10 and the thread-guide bar 2. Moreover, the motor 10 can be potentiated by increasing its length and therefore its longitudinal extension, both for the fixed part 11 and for the moving part 12, so as to be able to use the device 1 also in applications requiring a high power. In a preferred embodiment of the device 1, the moving part 12 of the motor 10 is basically shaped as a double T and generally the upper horizontal portion of the T has a larger front extension than the lower portion, still to minimize the front size of the motor 10 with respect to the thread-guide bar 2 (FIGS. 6, 10 and 11). A I-shape of the moving part 12 is however as suitable as the previous one for reducing the size difference between the motor 10 and the corresponding thread-guide bar 2, as shown in FIGS. 9A, 9B and 12. Specifically, it should be pointed out that the reduction of the front size difference between the motor 10 and the corresponding thread-guide bar 2 enables the motor 10 to work remaining always aligned with the corresponding bar 2.

According to the invention, the motor 10, whatever the shape of its moving part 12, comprises at least a second sliding guide 13 for the moving part 12. Advantageously, the motor 10 is equipped with at least two of said sliding guides 13 placed between the fixed part 11 and the moving one 12. Said guides 13 have the function to simplify the translational sliding of the moving part 12 with respect to the fixed one 11, to minimize their mutual distance (referred to as air gap) and therefore the overall size of the motor 10, preventing said moving part 12 from swinging laterally with the motor 10 on or off, thus making coils and magnets collide in the most extreme cases. Generally, the motor 10 is associated with very accurate sliding guides 13 having spheres or migration crossing, preloaded, opposed or similar rollers. Moreover, as can be seen in FIGS. 10 and 12, there are basically three second sliding guides 13 in the case of motors 10 whose moving part 12 is T-shaped, and four of them if the moving part 12 is I-shaped.

Furthermore, the device 1 can comprise detection devices (not shown) acting upon the motor 10 to steer and control the movement of the moving part 12 with respect to the fixed one 11. Advantageously, such detection devices comprise at least one accurate linear position transducer either of magnetic, optical, variable-reluctance etc. type.

The fixed part 11 of the motor 10 is generally anchored to a housing body acting as supporting frame also for the other parts of the motor 10.

In a preferred embodiment of the device 1, the mover 40 for moving the thread-guide bar 2 according to the oscillating movement are associated and cooperate with the transmission devices 20. The mover 40 and the transmission devices 20 are further advantageously mutually integrated and placed between the motor 10 and the thread-guide bar 2.

According to the invention, the mover 40 comprises a support 41 apt to move with oscillating motion around an axis of rotation 42, slidingly associated with the second transmission element 24 on at least a first engagement portion 43.

Such support 41 further has a second engagement portion 44 with which the second transmission element 24 is still slidingly associated for stiffly transmitting the oscillating motion to the thread-guide bar 2.

Advantageously, the support 41 is engaged with the second transmission element 24 on the first 43 and the second 44 engagement portion by means of sliding sleeves 45 which enable the second transmission element 24 to move with translational motion even if the support 41 is fixed with respect to the translation and only makes an oscillating movement.

The second transmission element 24 can therefore be basically L- or T-shaped and be directly connected to the thread-guide bar 2 and to the support 41 on the two engagement portions 43, 44 mentioned above.

As an alternative, in a preferred embodiment thereof, the device 1 can comprise a prop element 46 integrally connected to the thread-guide bar 2 and to the second transmission element 24 on its second end portion 26, preferably so that the middle axis of the second transmission element 24 is basically parallel to the one of the thread-guide bar 2 and the middle axis of the prop element 46 is basically perpendicular thereto (FIGS. 4, 5, 6, 7A, 7B, 9A and 9B). As a consequence, the support 41 is connected to the prop element 46 on the first engagement portion 43 by means of a sleeve 45, and to the second transmission element 24, still by means of a sleeve 45, on the second engagement portion 44. Preferably, the device 1 is equipped with a first sleeve 45 associated with the prop element 46 on the first engagement portion 43 of the support 41, and with a second sleeve 45 associated with said support 41 on the second engagement portion 44. In this case, therefore, the two sleeves 45 are opposed to one another, as can be seen in FIGS. 7A and 7B.

The engagement between the second transmission element 24 and, if required, the prop element 46 and the support 41 is highly innovating. It should therefore be pointed out that the present invention further protects a device 1 having a support 41 apt to move with oscillating motion and associated with a transmission element 24 on two engagement portions 43, 44, preferably by means of sleeves 45, so as to stiffly transmit to the thread-guide bars 2 an oscillating motion and to enable the translational motion, wherein the transmission element 24 is associated with a motor 10 by means of known systems such as articulated rods.

The operation of the device 1 according to the invention in a preferred execution variant can be synthesized as followed.

The linear motor 10 transmits through its moving part 12 a translational motion to the first transmission element 21 by means of the interface plate 30. Such translational motion is then transmitted to the second transmission element 24, which is stiff and integral to translation with respect to the first transmission element 21. Such second transmission element 24 transmits in its turn the translational motion to the thread-guide bar 2 through the prop element 46, to which these two components 24, 46 are stiffly connected. Thanks to the translational motion transmitted by the motor 10, the thread-guide bar 2 can execute the shog movement and, thus, can move in front of the hook of each needle.

Simultaneously to the shog movement, the thread-guide bar 2 should also make the swing movement so as to move to the side of each needle and allow the thread associated with each thread-guide to be correctly fed. The swing movement is generated by the oscillating movement of the support 41. Thanks to the connection of said support 41 to the second transmission element 24 and to the prop element 46 on the first 43 and second 44 engagement portion, such oscillating movement is stiffly transmitted from the support 41 to the thread-guide bar 2. Moreover, the second transmission element 24 and the prop element 46 are connected to the support 41 on the two engagement portions 43, 44 by means of sleeves 45 enabling the thread-guide bar 2 to stiffly move with oscillating motion with respect to said support 41 and enabling at the same time the second transmission element 24, the prop element 46 and the bar 2 to move with the translational motion transmitted by the motor 10.

The inventive idea of the present invention further includes a linear knitting machine 50 characterized in that it comprises at least one control device 1 for thread-guide bars 2 as described above.

Advantageously, a linear knitting machine 50 comprises a plurality of the control devices 1 described, since each of said devices 1 is associated with a thread-guide bar 2, each knitting machine including as a rule more than one, generally four to ten, of said bars.

According to the invention, in a linear knitting machine 50 the motors 10 of each device 1 are placed in a radial arrangement so as to basically build an arc in a plane basically parallel to the oscillating plane of the thread-guide bar 2, thus enabling the maximum approach between each of the motors 10 and the corresponding bar 2, as can be seen in FIGS. 4, 6, 9A and 9B.

Moreover, still in order to minimize the front size difference between motor 10 and thread-guide bar 2 and allow said bars 2 to work basically aligned with the corresponding motor 10, a first set of devices 1 (FIG. 9A) is associated with one of the two end portions 2*a* of the bars 2, whereas a second set of devices 1 (FIG. 9B) is associated with the opposite end portion 2*a*. Preferably, the control devices 1 are alternatively arranged on an end portion 2*a* of the bar 2 and on the opposite one, as can be seen in FIGS. 9A and 9B.

As a result of the radial arrangement, the devices 1 in a machine 50 can have components, such as the interface plate 30 or the first transmission element 21, differing from one another since each device 1 should have its center of thrust and oscillation very close to the axis of the moving part 12 of the linear motor 10 for balancing stresses.

The knitting machine 50 comprises at least a suitable number of prop elements 46 with respect to the number of thread-guide bars 2, and at least two supports 41 generating the oscillating motion. In further detail, each of these two supports 41 is associated with each of the second transmission elements 24 of the devices 1 and, if required, also with each of the prop elements 46, whereas the other one is associated on an end portion 2*a* of the thread-guide bar 2 opposed to the one with which each device 1 is associated. Similarly, each thread-guide bar 2 is associated with at least two prop elements 46 on each of the two end portions 2*a*, as well as with a central prop element 46 for better balancing the knitting machine 50.

Preferably, the linear knitting machine 50 according to the present invention has a so-called "portal" configuration and the motors 10 and the control devices 1 for the thread-guide bars 2 are equally located inside the two shoulders of the machine 50.

The description below can apply both to machines with thread-guide bars 2 having a length of about one meter, suitable for making ribbons, scarves etc., and to machines with bars 2 having a length above 3 m used for knitting clothing items (stockings, sheets etc.).

A warp-knitting machine 50 for carrying out a method according to the present invention therefore comprises a first thread-guide 3 bar 2 of jacquard type (preferably a plurality of said bars 2), a first linear motor 10 (preferably a plurality of motors 10 connected to corresponding bars 2) apt to transmit a shog translational movement to the first thread-guide 3 bar 2, the first linear motor 10 being configured so as to vary the shift width of the first thread-guide 3 bar 2 at least between a first predefined width corresponding to a first predefined number of needle spaces of the knitting machine, and at least a second width corresponding to a second predefined number of needle spaces.

The machine 50 further comprises said mover 40 for moving the first thread-guide bar 2 according to a swing oscillating motion transversal to the translational motion, and said transmission devices 20 for transmitting to the first thread-guide bar 2 the translational motion of the first linear motor 10, thus enabling the oscillating motion.

According to the present invention, the machine 50 further comprises control devices 60 (not described in detail since of conventional type, advantageously operatively connected to the general control devices 51 of the machine 50) connected to linear motor 10 and programmable for setting, selecting and/or varying automatically the width of the shog movement of the first thread-guide bar, and further connected to the first jacquard thread-guide 3 bar 2 so as to further control the individual movements of the thread-guides 3 of the first bar 2, also in a coordinated manner with the width variations of the shog movement of the first thread-guide 3 bar 2.

The thread-guide 3 bars 2 can be provided with jacguard devices 6 of piezoelectric (such as those shown in FIGS. 4 and 4*a*) or pneumatic type, but in a less preferred embodiment they could also be provided with mechanical jacquard devices.

Preferably, the linear motor 10 is configured so as to vary the shift width of the first thread-guide bar 2 between a first and second predefined width, differing from one another of a plurality of needle spaces, preferably of at least five needle spaces, and still more preferably of at least ten needle spaces. Moreover, the first and the second predefined width could differ of at least twenty needle spaces, and preferably of at least fifty needle spaces. The needle spaces indicated above refer for instance to a machine with a GG24 fineness, i.e. 24 needle per inch. The same absolute value of shift in inches has different effects depending on the machine fineness, and obviously the extent of shift is related to number of needle spaces with which the bar should shift according to the method and to the size of the single needle space, deriving from the machine fineness.

According to the invention, a method for producing textile articles with warp-knitting machines is now described, comprising a plurality of steps of shifting at least a first thread-guide 3 bar 2 of jacquard type with shog translational movements and with swing movements transversal and alternated to shog movements, so as to produce the textile articles on at least one needle bed 52 of the knitting machine 50. The needles of the needle bed 52 (in the preferred embodiment two needle beds 52), not shown in detail in the figures since it is of known type like the remaining parts of the machine 50 that are not shown, can be of latch or compound type.

The method according to the present invention further includes the steps of shifting at least said first thread-guide bar 2 by means of a corresponding first linear motor 10, with a shog movement of a first predefined width corresponding to a first predefined number of needle spaces, varying automatically through control devices 60 connected to said linear motor 10 the shift controlled by the first linear motor 10 so as to vary the width of the shog movement during the production of the textile articles, and shifting at least the first thread-guide 3 bar 2 by means of the first linear motor 10 with a shog movement having a second predefined width, different from the first predefine width and corresponding to a second predefined number of needle spaces. Preferably, the method includes the step of shifting a plurality of bars 2 of jacquard type, by means of a corresponding plurality of linear motors 10, of said first and second shog movement.

The first and second predefined width differ of a plurality of needle spaces, i.e. for instance at least five needle spaces, preferably at least ten needle spaces. Still more preferably, they can differ of at least twenty needle spaces or of at least fifty needle spaces.

In short, according to the present invention it is possible to define freely and without any manual intervention the width of the shog movement of the jacquard thread-guide 3 bar 2, thus obtaining any desired shift (with suitable linear motors 10 such travel can be extended up to more or less one hundred needles and above, referred for instance to a machine with fineness 24) and being able to vary such shift in a completely free manner by suitably programming the control devices 60. As already stated, the shift of the bar in terms of number of needles is related to the machine fineness, the absolute shift being the same (for instance in inches). As a matter of fact, the size of the single needle space with which the bar shifts (and thus each thread-guide which is not shifted individually) depends on the machine fineness, and therefore for instance with fineness 3 the size of a single needle space is eight times larger than the size of a needle space with fineness 24. Therefore, the same shift in absolute value in inches of the bar on a machine with fineness 3 corresponds to a shift in terms of needle spaces that is an eighth of the shift in needle spaces on a machine with fineness 24.

In a preferred embodiment, the step of automatically varying the width of the shog movements is executed during the production of the same textile article, which is manufactured with a plurality of different shift widths of the first thread-guide 3 bar 2 during corresponding shog movements and with a plurality of individual shifts of the first thread-guide 3.

In addition to the shog movement, the method further comprises the step of automatically controlling by means of the control devices 60 connected to the first thread guide bar at least an individual shift of a needle space of at least a first thread-guide 3, and preferably of a plurality of thread-guides 3 (each with its specific individual movement which might differ from the one of the other thread-guides), at least of the first thread-guide 3 bar 2 of jacquard type, during at least one of said shog movements of the first and/or second predefined width.

According to the desired knitting stitch, the individual shift can be in addition to, in the same direction, or in deduction from, in the opposite direction, the corresponding shog movement of the thread-guide bar.

Figure 13:
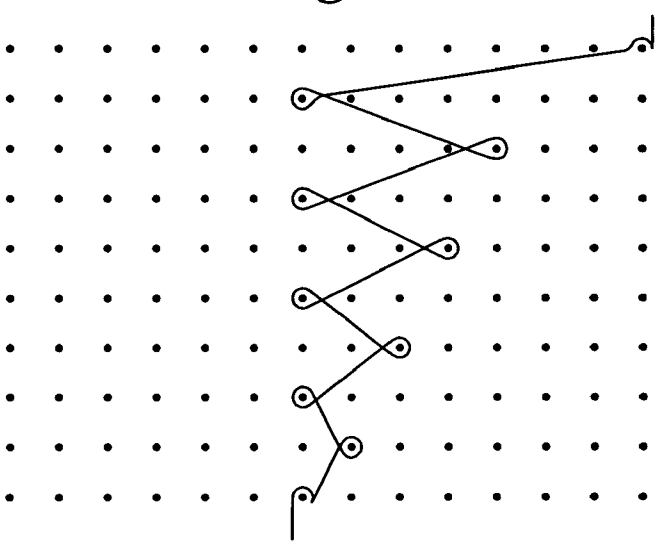
FIG. 13 shows a schematic representation of an example of a knitting path according to the present invention.
Figure 3:
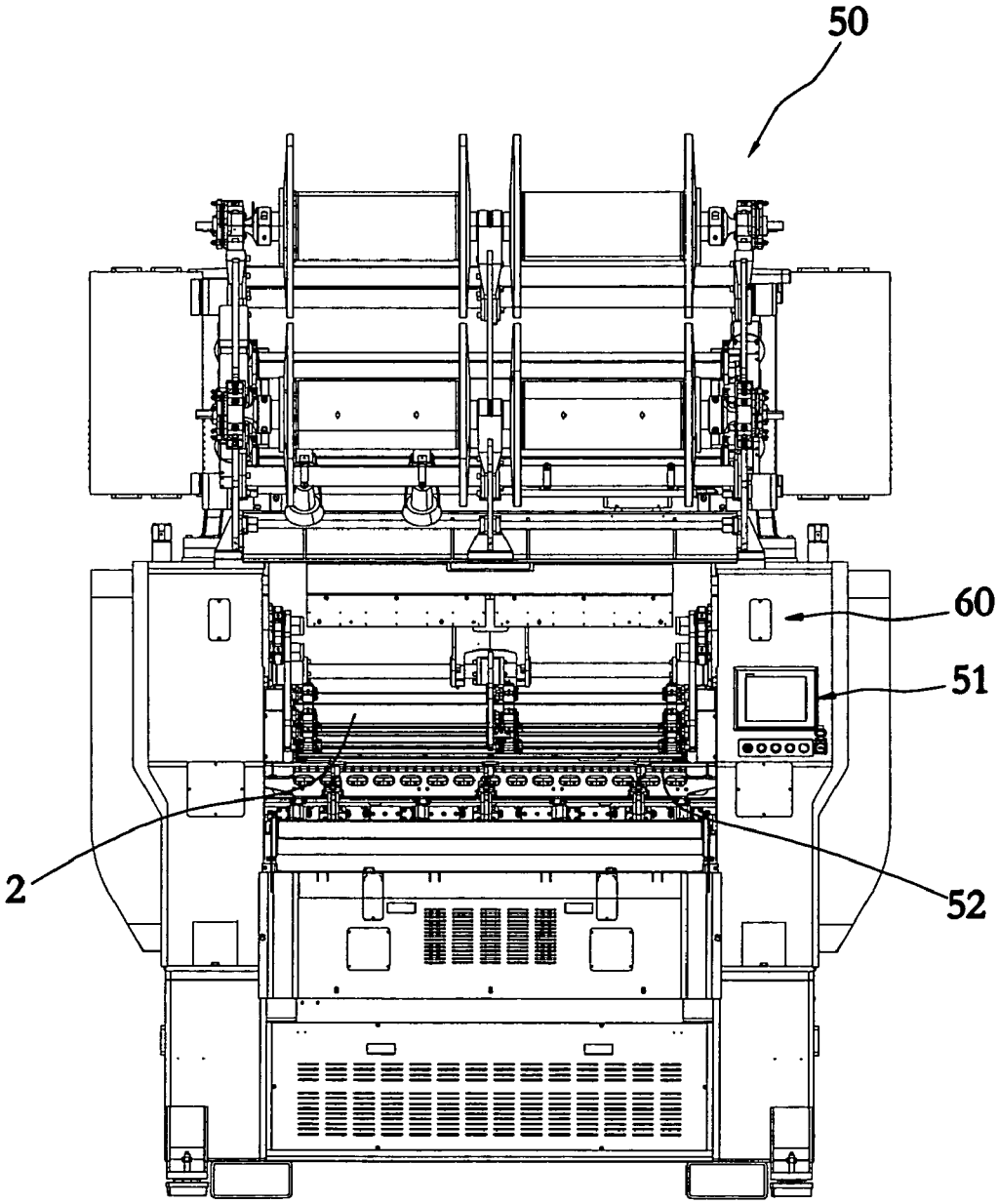
FIG. 3 shows a front view of a warp-knitting machine according to the present invention.

As shown in the example of FIG. 13, the method according to the present invention enables to freely vary the shift width of the shog movement of the thread-guide 3 bars 2, which is progressively increased in the example shown in the figure and which is combined in the first row and in the last row with an individual shift of the single jacquard thread-guide 3.

The invention also relates to a textile article manufactured with the method and/or the machine 50 described, which is obtained by means of a plurality of shog shifts of a width varying of a plurality of needle spaces, and by means of a plurality of individual movements of jacquard-type thread-guides 3.

Such textile knitted article can be provided with jacquard or transparent effects obtained with woven yarns or variously arranged and/or knitted floating yarns, and such yarns can be arranged horizontally, vertically and diagonally with other yarns concurring to fabric formation.

The invention thus conceived can be subject to many changes and variants, all which fall within the frame-work of the inventive idea.

In practice, any material or size can be used depending on the various needs. Moreover, all details can be replaced with other technically equivalent elements.

The invention achieved important advantages.

First of all, a method according to the present invention allows to manufacture fabrics characterized by more complex and complete jacquard patterns than the prior art, in a swift and economic manner. This results also from the possibility of varying automatically, rapidly and without manual interventions the width of the shog movement of the thread-guide bars within a very large width range.

Furthermore, a warp-knitting machine according to the present invention is compact and has a significantly smaller number of components than other machines, which has advantages in terms of costs, machine simplicity and life time of components.

Moreover, the machine can work at high speeds with a good balancing of stresses and faulty operations are less likely to take place.

Furthermore, the machine offers a highly working accuracy and ensures a high-quality finished product.

The invention claimed is:

1. A method for producing textile articles with warp-knitting machines, comprising a plurality of steps of shifting at least a first thread-guide (3) bar (2) of jacquard type of said knitting machine (50) with shog translational movements and with swing movements transversal and alternated to said shog movements, so as to produce said textile articles on at least one needle bed (52) of said knitting machine (50), and further comprising the following steps:

shifting at least said first thread-guide (3) bar (2) by means of a corresponding first linear motor, with a shog movement of a first predefined width corresponding to a first predefined number of needle spaces related to machine fineness;

varying automatically through control devices (60) connected to said linear motor the shift controlled by said first linear motor so as to vary the width of the shog movement during the production of said textile articles, and shifting at least said first thread-guide (3) bar (2) by means of said first linear motor (10) with a shog movement having a second predefined width, different from said first predefined width and corresponding to a second predefined number of needle spaces; and automatically controlling by means of said control devices (60) connected to said first thread guide (3) bar (2) at least an individual shift of a needle space of at least a first thread-guide (3) of said first thread-guide (3) bar (2) of jacquard type, during at least one of said shog movements of said first and/or second predefined width, said individual shift being in addition to, in the same direction, or in deduction from, in the opposite direction, the corresponding shog movement of said thread-guide bar; said step of automatically varying the width of said shog movements being executed during the production of the same textile article, which is manufactured with a plurality of different shift widths of said first thread-guide (3) bar (2) during corresponding shog movements and with a plurality of individual shifts of said first thread-guide (3).

2. The method according to claim 1, characterized in that it comprises the steps of shifting a plurality of jacquard-type bars (2) by means of a corresponding plurality of linear motors (10) of said first and second shog movement.

3. The method according to claim 1, characterized in that said step of making an individual shift of a needle space of at least a first thread-guide (3) of said first thread-guide (3) bar (2) is executed by actuating a jacquard device (6) of piezoelectric type acting upon said first thread-guide (3).

4. The method according to claim 1, characterized in that said step of making an individual shift of a needle space of at least a first thread-guide (3) of said first thread-guide (3) bar (2) is executed by actuating a jacquard device (6) of pneumatic type acting upon said first thread-guide (3).

5. The method according to claim 1, characterized in that it comprises the step of shifting a plurality of thread-guides (3) of said individual shifts of a needle space during at least one of said first and/or second shog movements of said first and/or said second predefined width.

6. The method according to claim 1, characterized in that said first and said second predefined width differ of a plurality of needle spaces.

7. The method according to claim 6, characterized in that said first and said second predefined width differ of at least five needle spaces.

8. The method according to claim 7, characterized in that said first and said second predefined width differ of at least twenty needle spaces.

9. A warp-knitting machine comprising at least:

a first thread-guide (3) bar (2) of jacquard type;

a first linear motor (10) apt to transmit a shog translational motion to said first thread-guide (3) bar (2), said first linear motor (10) being configured so as to vary the shift width of the first thread-guide bar (2) at least between a first predefined width corresponding to a first predefined number of needle spaces of said knitting machine (50), and at least a second width corresponding to a second predefined number of needle spaces;

a mover (40) for moving said first thread-guide bar (2) according to a swing oscillating motion basically perpendicular to said translational motion;

transmission devices (20) for transmitting to said first thread-guide bar (2) said translational motion of said first linear motion (10), thus enabling said oscillating motion;

control devices (60) connected to said linear motor (10) and programmed for setting, selecting and/or varying automatically the width of said shog movement of said first thread-guide (3) bar (2), said control devices (60) controlling said first linear motor for shifting at least said first thread-guide (3) bar (2) with a shog movement of a first predefined width corresponding to a first predefined number of needle spaces related to machine fineness, varying automatically the shift controlled by the first linear motor so as to vary the width of the shog movement during the production of a textile article, and controlling said first linear motor for shifting at least said first thread-guide (3) bar (2) with a shog movement having a second predefined width, different from said first predefined width and corresponding to a second predefined number of needle spaces; and said control devices (60) being further connected to said jacquard thread-guide (3) bar (2) for further controlling the individual movements of the thread-guides of said first thread-guide (3) bar (2), in a coordinated manner with said width variations of the shog movement of said first thread-guide (3) bar (2) during at least one of said shog movements of said first and/or second predefined width, said individual shift being in addition to, in the same direction, or in deduction from, in the opposite direction, the corresponding shog movement of said thread-guide bar, said textile article being manufactured with a plurality of different shift widths of said first thread-guide (3) bar (2) during corresponding shog movements and with a plurality of individual shifts of said first thread-guide (3).

10. The machine according to claim 9, characterized in that said transmission devices (20) comprise a first transmission element (21) associated and integral with said linear motor (10), and a second transmission element (24) that can be integrally associated with said thread-guide bar (2), said first transmission element (21) having a first guide (22) inside which said second transmission element (24) is engaged or vice versa.

11. The machine according to claim 9, characterized in that it comprises a plurality of said thread-guide (3) bars (2) of jacquard type and a plurality of said linear motors (10) associated accordingly with said thread-guide (3) bars (2).

12. The machine according to claim 9, characterized in that said thread-guide (3) bars (2) are provided with jacquard devices (6) of piezoelectric type.

13. The machine according to claim 9, characterized in that said thread-guide (3) bars (2) are provided with jacquard devices (6) of pneumatic type.

14. The machine according to claim 9, characterized in that said linear motor (10) is configured so as to vary the shift width of said first thread-guide bar (2) between a first and a second predefined width which differ from one another by at least five needle spaces.

15. The machine according to claim 14, characterized in that said first and said second predefined width differ of at least twenty needle spaces.

16. A textile article manufactured with a method according to claim 1, characterized in that it is manufactured by means of a plurality of shog shifts of a width varying of a plurality of needle spaces and by means of a plurality of individual movements of jacquard-type thread-guides (3).

17. The textile article according to claim 16, characterized by jacquard or transparent effect obtained with woven yarns, variously arranged floating or knitted floating yarns, said yarns being arranged horizontally, vertically and diagonally with other yarns concurring to fabric formation.

18. The method according to claim 6, characterized in that said first and said second predefined width differ of at least ten needle spaces.

19. The method according to claim 7, characterized in that said first and said second predefined width differ of at least fifty needle spaces.

20. The machine according to claim 14, characterized in that said first and said second predefined width differ of at least fifty needle spaces.

* * * * *